United States Patent [19]

Amorese et al.

[11] Patent Number: 5,038,520

[45] Date of Patent: Aug. 13, 1991

[54] MANWAY LIFT ASSIST

[75] Inventors: Franklyn J. Amorese, Hilton; Robert R. Loomis, Rochester; Douglas H. Rigerman, Leroy, all of N.Y.

[73] Assignee: The Pfaudler Companies, Inc., Rochester, N.Y.

[21] Appl. No.: 607,522

[22] Filed: Nov. 1, 1990

[51] Int. Cl.[5] ..... E05F 1/10

[52] U.S. Cl. ..... 49/386

[58] Field of Search ..... 49/386, 379, 381, 402

[56] References Cited

U.S. PATENT DOCUMENTS

| | | | |
|---|---|---|---|
| 2,589,427 | 3/1952 | Ossmann | 49/386 X |
| 2,593,379 | 4/1952 | Wueste | 49/386 |
| 2,716,256 | 8/1955 | Wise | 49/379 |
| 3,714,680 | 2/1973 | Little | 49/386 X |
| 4,010,572 | 3/1977 | Peterson | 49/386 |
| 4,137,669 | 2/1979 | Nunlist | 49/386 |
| 4,589,613 | 5/1986 | Opsahl | 49/386 X |
| 4,844,567 | 7/1989 | Chalabian | 49/386 X |
| 4,985,939 | 1/1991 | Otte | 49/386 X |

FOREIGN PATENT DOCUMENTS

| | | | |
|---|---|---|---|
| 1249032 | 8/1961 | Fed. Rep. of Germany | 49/402 |
| 1172986 | 6/1964 | Fed. Rep. of Germany | 49/386 |
| 1459191 | 11/1968 | Fed. Rep. of Germany | 49/386 |
| 1221886 | 6/1960 | France | 49/386 |
| 653125 | 2/1963 | Italy | 49/386 |
| 1272405 | 4/1972 | United Kingdom | 49/386 |

*Primary Examiner*—Rodney M. Lindsey
*Assistant Examiner*—Jerry Redman
*Attorney, Agent, or Firm*—Michael L. Dunn

[57] ABSTRACT

The invention relates to an improved balancing aid for a pivotally mounted cover for a manhole comprising means for hinging the cover relative to the manhole so the cover may be rotated about the hinge to expose and cover the manhole; and a spring retaining means comprising a rod pivotally secured to the cover, said rod being at least partially encased by a housing, said housing containing a compression spring means which is compressed when the cover is closed; wherein the improvement comprises securing the spring retaining means by attachment means which may be removed only after the spring means is first removed.

5 Claims, 2 Drawing Sheets

MANWAY LIFT ASSIST

BACKGROUND OF THE INVENTION

This invention relates to manhole covers for access to enclosed spaces such as tanks, conduits and storage areas and more particularly relates to mechanisms to assist in balancing the weight of manhole covers.

Such balancing mechanisms have been known, as for example are disclosed in U.S. Pat. No. 4,137,669, incorporated herein by reference.

Typically, the weight of the manhole cover is at least partially balanced by a spring mechanism, e.g., as shown in U.S. Pat. No. 4,137,669. Such balancing mechanisms have been very beneficial in reducing the amount of force required to lift and retain the manhole cover in an open or partially open position and have reduced risk of injury as a result of muscular strain in lifting the cover and have also reduced the probability of injury to person or property as a result of the full unbalanced weight of the cover falling upon a person or property.

Nevertheless, such balancing mechanisms still have certain disadvantages. In particular retaining bolts can be removed from such devices when the cover is closed, e.g., to entirely remove the cover or for maintenance, without first releasing the considerable energy stored in the balancing springs which may result in dangerous and unpredictable release of such energy.

In addition, such mechanisms have had a considerable number of exposed nuts, threads and other parts which tend to collect dirt in the form of dust, grease, chemicals and other contamination and are difficult to clean Such mechanisms have also tended to corrode. These tendencies have made known balancing mechanisms for manhole covers less than desirable for use in food and pharmaceutical industries.

BRIEF DESCRIPTION OF THE INVENTION

Figure 1:
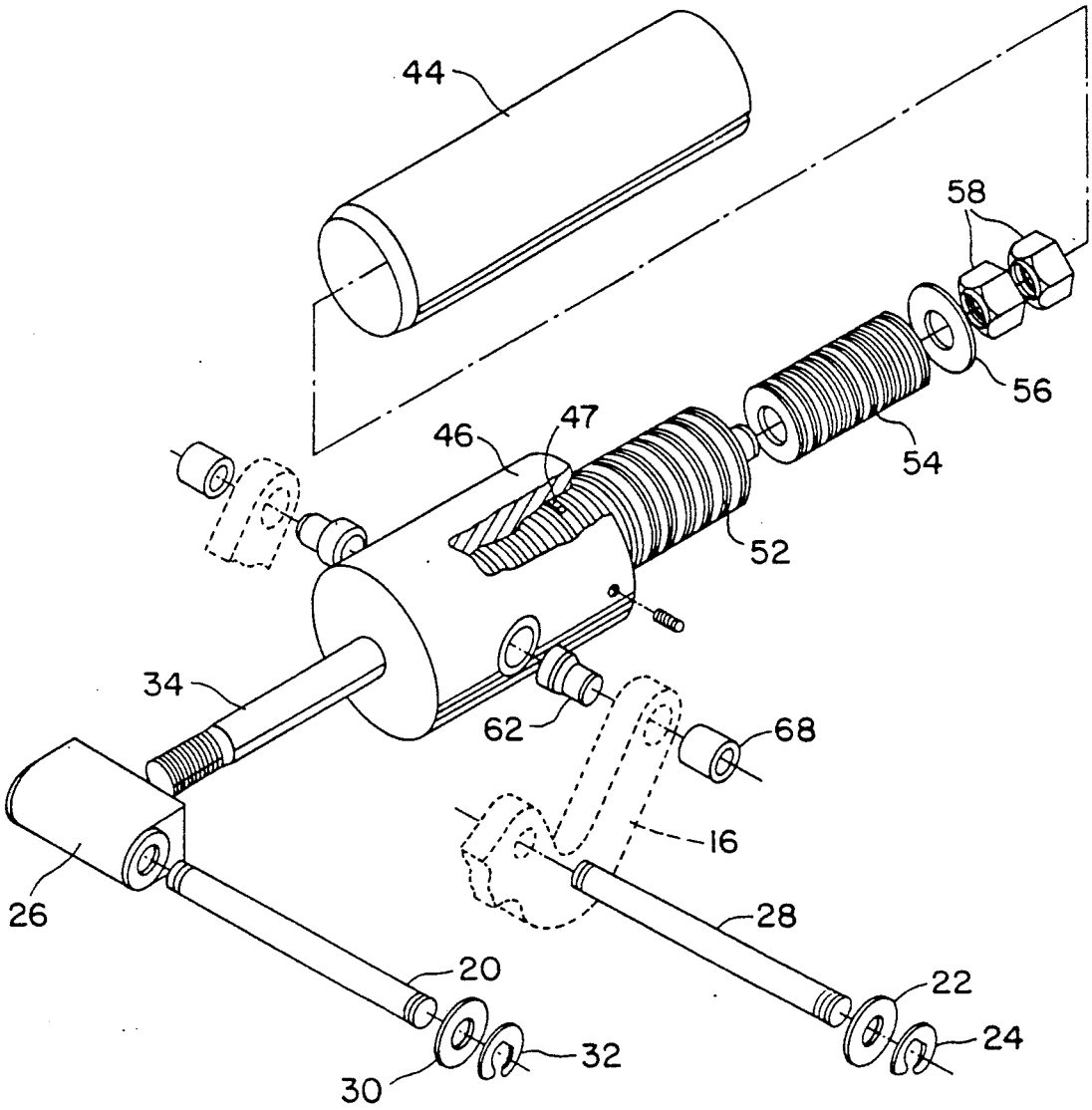
FIG. 1 shows an exploded perspective view of a preferred embodiment of a balancing mechanism for manhole covers in accordance with the present invention.

In accordance with the present invention, there is therefore provided a balancing mechanism for a manhole cover which is difficult to disassemble while energy remains stored in balancing springs and which presents an exterior having fewer areas which tend to accumulate dirt and which is easier to clean.

More particularly, the invention is an improved balancing aid for a pivotally mounted cover for a manhole. The balancing aid comprises means for an improved balancing aid for a pivotally mounted cover for a manhole comprising means for hinging the cover relative to the manhole so the cover may be rotated about the hinge to expose and cover the manhole; and a spring retaining means comprising a rod pivotally secured to the cover, said rod being at least partially encased by a housing, said housing containing a compression spring means which is compressed when the cover is closed, wherein the improvement comprises securing the spring retaining means by attachment means which may be removed only after the spring means is first removed.

The attachment means desirably comprises shouldered bearing pins which are inserted from the inside through the wall of the housing into support brackets so that they may not be removed without first removing the spring means. As a result, energy stored in the spring will not be suddenly released upon removal of the bearing pins. In addition, since the shoulders do not externally protrude they do not collect dirt which can be an undesirable source of contamination, especially in pharmaceutical and food preparation applications.

To further prevent contamination, the parts, except perhaps the contained spring, are desirably manufactured from stainless steel.

DETAILED DESCRIPTION OF THE INVENTION

The invention relates to mechanisms which assist in balancing the weight of manhole covers.

A manhole, as used herein, is a hole into a contained area, which is at least large enough to allow a man to enter the area. As used herein, the term manhole includes much larger holes, e.g., those which would permit simultaneous passage of a number of men, equipment, apparatus and other materials.

The means for hinging the cover relative to the manhole may be any suitable means. Such a means is, for example, shown in FIGS. 1 and 2 wherein cover 10 is provided with pivot arms 12, which desirably are essentially parallel to and outwardly extend from cover 10. "Essentially parallel" as used herein means that the longitudinal axes do not diverge from each other at an angle greater than 10 degrees. A support bracket 14 is provided which comprises parallel bracket arms 16 rigidly secured relative to the manhole, e.g., at vessel sidewall 18. Pivot arms 12 are pivotally secured to bracket arms 16 by means of hinge pin 20 held in place by washers 22 and retaining rings 24.

The spring retaining means may be any suitable means wherein a spring is held in tension or compression to counterbalance the weight of the manhole cover.

Figure 2:
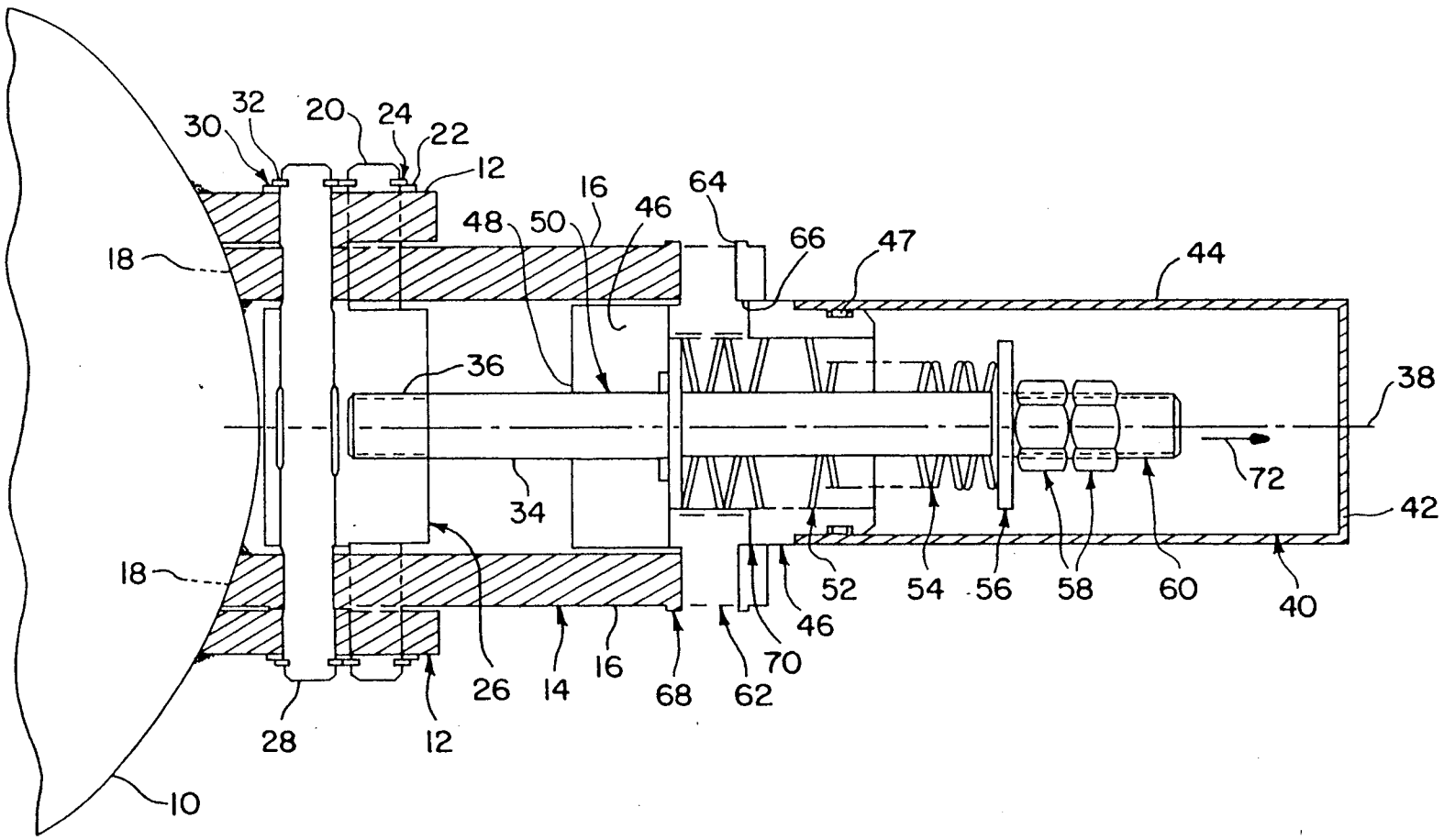
FIG. 2 shows a longitudinal cross sectional view of the assembled mechanism of FIG. 1.

As seen in FIGS. 1 and 2, in a preferred embodiment of the spring retaining means, a cross head 26 is pivotally mounted between pivot arms 12 at a position above the mounting of pivot arms 12 to support bracket 14. Cross head 26 is mounted to pivot arms 12 by means of hinge pin 28 held in place by washers 30 and retaining rings 32.

A pull rod 34 is secured to cross head 26, by means of threads 36. Longitudinal axis 38 of the pull rod 36 is essentially perpendicular to cross head 26, i.e., within 10 degrees of perpendicular to the longitudinal axis of cross head 26.

A housing 40 is provided which encases at least a portion of pull rod 34. Housing 40 is provided with rear end wall 42 and sidewall 44.

The front of housing 40 is closed by means of yoke 46 and seal 47. Yoke 46 is provided with an opening 48, lined by bearing sleeve 50 through which pull rod 36 may longitudinally travel. At least one compression spring 52 and preferably a second compression spring 54 are provided about pull rod 36. Springs 52 and 54 are retained on pull rod 36 by means of washer 56 and retaining nuts 58 which are threaded over threaded end 60 of pull rod 36. Yoke 46 is secured to support bracket arms 16 by means of shoulder bearing pins 62 connecting communicating holes 64 and 66 in bracket arms 16 and yoke 46 respectively. Holes 64 and 66 may be lined with sealing bearing sleeves 68 and 70.

As can be seen from the drawings, shoulder bearing pins 62 are inserted from the interior and cannot be removed without first removing springs 52 and 54. As can also be seen from the drawings, the assembly of the shoulder bearing pins 62 leaves no protruding exterior surface to collect and retain contaminants.

In operation, manhole cover 10 is opened by pivoting pivot arms 12 about hinge pin 20. In doing so, cross head 26, secured to pivot arms 12 by means of hinge pin 28, moves away from the manhole in the direction of arrow 72, as does pull rod 34 which is secured to cross head 26. As pull rod 34 retracts, compressive energy is released in springs 52 and 54. When manhole cover 10 is closed, pull rod 34 moves in a direction opposite arrow 72 thus progressively compressing springs 52 and 54 as cover 10 approaches the manhole thus tending to balance the gravitational force acting against cover 10.

In order to remove yoke 46 from bracket arms 16, cover 44 must be removed followed by removal of springs 52 and 54 and shoulder bearing pins 62. Springs 52 and 54 are removed by unscrewing nuts 56 and 58 which gradually reduces the quantity of energy stored in the springs. Thus, it is clear that compressive energy stored in springs 52 and 54 must be released before the yoke 46 can be removed from bracket arms 16, thus reducing potential for sudden and explosive release of that energy by detaching yoke 46 before such release, as was possible with prior art balancing mechanisms, and further that bearing pins 62 have no exposed protrusions to collect contaminants as did yoke attachment means used in the prior art.

WHAT IS CLAIMED IS:

1. An improved balancing aid for a pivotally mounted cover for a manhole comprising:

means for hinging the cover relative to the manhole so the cover may be rotated about the hinge to expose and cover the manhole; and a spring retaining means comprising a rod pivotally secured to the cover, said rod being at least partially encased by a housing, said housing containing a compression spring means which is compressed when the cover is closed;

wherein the improvement comprises securing the spring retaining means by an attachment means which may be removed only after the spring means is first removed.

2. The balancing aid of claim 1 wherein the hinging means, housing, rod and attachment means comprise stainless steel.

3. An improved balancing aid for a pivotally mounted manhole cover for a manhole comprising:

a support bracket below the cover rigidly secured relative to the opening;

said support brackets comprising two essentially parallel arms outwardly extending from the opening;

dual essentially parallel pivot arms secured to the cover and outwardly extending therefrom and pivotally mounted to the parallel arms of the support bracket;

a cross head pivotally mounted between the pivot arms, said cross head being mounted to the pivot arms at a position above the mounting of the pivot arms to the support bracket;

a pull rod secured to the cross head, the longitudinal axis of the pull rod being essentially perpendicular to the cross head;

a spring retaining yoke secured to the support bracket said yoke having an opening therein which allows the pull rod to move forward through the yoke;

at least one compression spring surrounding the pull rod and retained thereon by the yoke, and a retaining means at an end of the pull rod such that closing the cover causes forward movement of the pull rod toward the manhole opening and compressing the spring against the yoke;

wherein the improvement comprising securing the yoke to the support bracket by shoulder bearing pins connecting communicating holes in the yoke and support bracket wherein the pins are inserted from an interior portion of the yoke so that they may not be removed without first removing the spring.

4. The balancing aid of claim 3 wherein at least a portion of the pull rod and spring are enclosed by a cover.

5. The balancing aid of claim 4 wherein the cover, yoke, shoulder bearing pins, pull rod, cross head, support bracket and pivot arms comprise stainless steel.

* * * * *